US005685737A

United States Patent [19]

Morin et al.

[11] Patent Number: 5,685,737

[45] Date of Patent: Nov. 11, 1997

[54] ELECTRICAL CONNECTOR HAVING A VISUAL INDICATOR

[75] Inventors: Scott Frederick Morin, San Jose; Brian Patrick Costello, Redwood City, both of Calif.; James Pritulksy, Hummelstown, Pa.

[73] Assignee: The Whitaker Corporation, Wilmington, Del.

[21] Appl. No.: 681,576

[22] Filed: Jul. 29, 1996

[51] Int. Cl.[6] ..... H01R 3/00

[52] U.S. Cl. ..... 439/490

[58] Field of Search ..... 439/488, 489, 439/490, 638, 676

[56] References Cited

U.S. PATENT DOCUMENTS

| | | | |
|---|---|---|---|
| 4,379,606 | 4/1983 | Clark et al. | 339/17 CF |
| 4,445,164 | 4/1984 | Giles, III et al. | 362/311 |
| 4,924,213 | 5/1990 | Decho et al. | 340/653 |
| 4,978,317 | 12/1990 | Pocrass | 439/490 |
| 5,188,542 | 2/1993 | Ballman | 439/620 |
| 5,466,174 | 11/1995 | Savage, Jr. | 439/596 |
| 5,470,252 | 11/1995 | Fladung | 439/490 |
| 5,480,319 | 1/1996 | Vlakancic | 439/490 |
| 5,601,451 | 2/1997 | Driones et al. | 439/490 |

*Primary Examiner*—Khiem Nguyen
*Assistant Examiner*—Yong Ki Kim
*Attorney, Agent, or Firm*—Salvatore Anastasi

[57] ABSTRACT

This invention provides a modular jack receptacle connector (2) which has at least one recess (10) for receiving an indicator (4). The recess is profiled to have a lead receiving section (26) with detents (32) along its sides for retaining at least one of the leads (6) which extend rearwardly and then downwardly from the indicator (4). Also provided along the sides of the recess are guide projections (12) for cooperating with guide recesses (14) in the indicator (4) for proper alignment of the indicator in the receptacle (2).

5 Claims, 2 Drawing Sheets

ELECTRICAL CONNECTOR HAVING A VISUAL INDICATOR

FIELD OF THE INVENTION

This invention relates to electrical connectors and more particularly to electrical connectors having a visual indicator.

BACKGROUND OF THE INVENTION

Modular jack receptacle connectors are well known in the telecommunications industry and have been adapted for mounting to printed circuit boards. These connectors are typically used for electrical connection between two electrical communication devices. In order to ensure that a proper connection has been made and therefore a link is created between the electrical communication devices, indicators are often incorporated into circuits on the printed circuit board. These indicators are typically light emitting diodes (LEDs) which are turned on when a circuit is completed between the mating connectors and the communication devices. Additionally LEDs can be mounted on the printed circuit board to indicate a number of other conditions including the passage of communications signals between the two communication devices, indication of power, or indication that an error in transmitting the signals has occurred.

In an effort to miniaturize printed circuit boards and save board real estate, LED indicators have been integrated into these connectors. An example of such a connector is disclosed in U.S. Pat. No. 4,978,317 to Pocrass which teaches a connector for receiving a plug having a visual indicator positioned within the front wall of the electrical connector housing. Incorporation of the indicator into the electrical connector eliminates the need for a separate location on the printed circuit board for mounting of such an indicator. The LED indicator is inserted into a recess of the electrical connector such that its electrical leads pass through the recess and connect to the printed circuit board. The indicator is then cemented into a recess or attached using an appropriate adhesive. The LEDs may also be molded into the electrical connector during the molding process of the housing.

A problem arises with these connectors in that it is difficult to properly position the leads of the LED for accurate mounting to the corresponding openings in the printed circuited board Additionally, because the anode and cathode leads of the LED are side by side confusion and misconnection can result prior to board mounting. It is also desirable to eliminate the need for securing the LED in the housing by cementing or attaching with an adhesive.

SUMMARY OF THE INVENTION

It is therefore the object of this invention to provide a modular jack connector suitable for mounting to a printed circuit board having at least one recess for receiving an indicator, guide means for positioning the indicator and securing means for securing the indicator.

The object of the invention has been achieved by providing a modular jack connector having a recess which is profiled to have a guide projection extending from its sidewall into the recess for cooperation with a guide groove on the indicator. The recess is also provided with a lead receiving section having protuberances which cooperate with the leads of the indicator for securing the indicator therein once it is fully inserted with the recess.

BRIEF DESCRIPTION OF THE DRAWINGS

The invention will now be described by way of example with reference to the following figures of which.

DETAILED DESCRIPTION OF THE INVENTION

Figure 1:
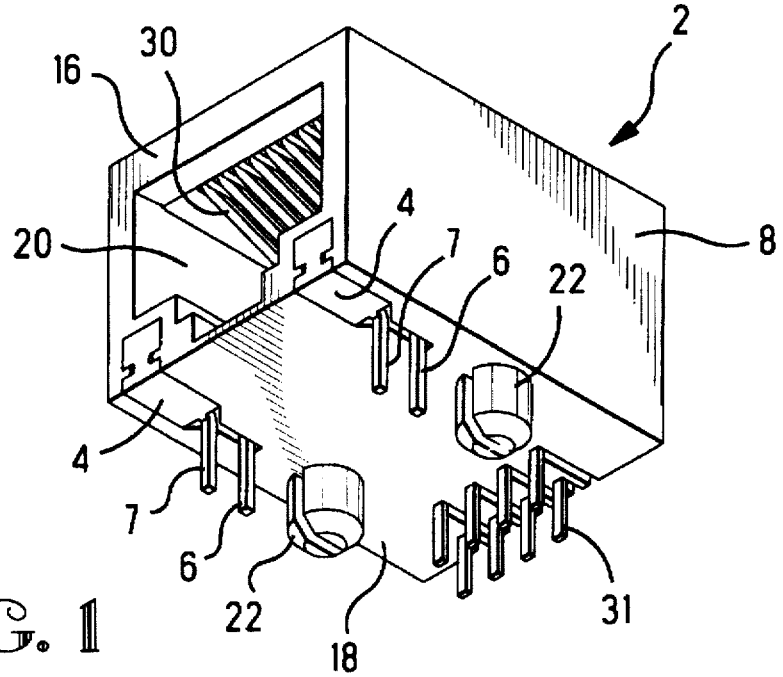
FIG. 1 shows a three dimensional view of the modular jack connector according to this invention.

The modular jack receptacle connector 2 will now be described generally with reference to FIG. 1. The modular jack receptacle 2 consists of an insulative housing 8 having a board mounting face 18 and a mating face 16. The plug-receiving or main cavity 20 extends inward from the mating face 16 for receiving a complimentary plug connector (not shown). The insulative housing 8 is also formed with auxiliary cavities 10 for receiving indicators 4 therein. The indicators 4 are adapted for electrical connection to the printed circuit board (not shown) through leads 6,7 extending from the rear of the indicators 4 to board mounting face 18.

Figure 2:
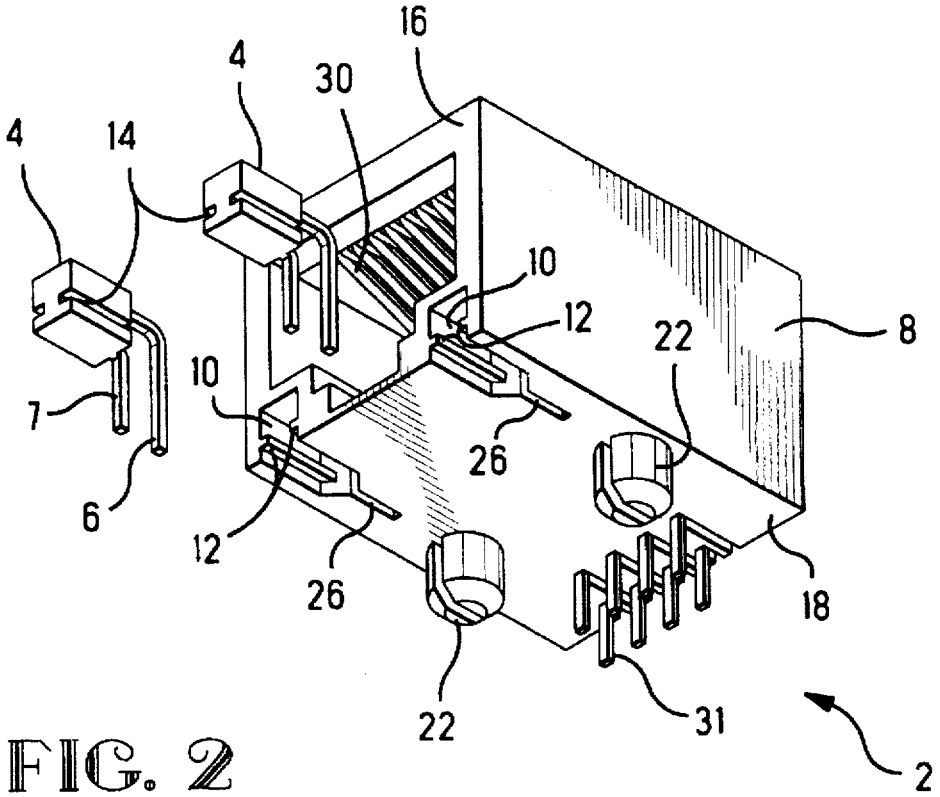
FIG. 2 shows a three dimensional exploded view of the modular jack connector and the indicators according to this invention.
Figure 3:
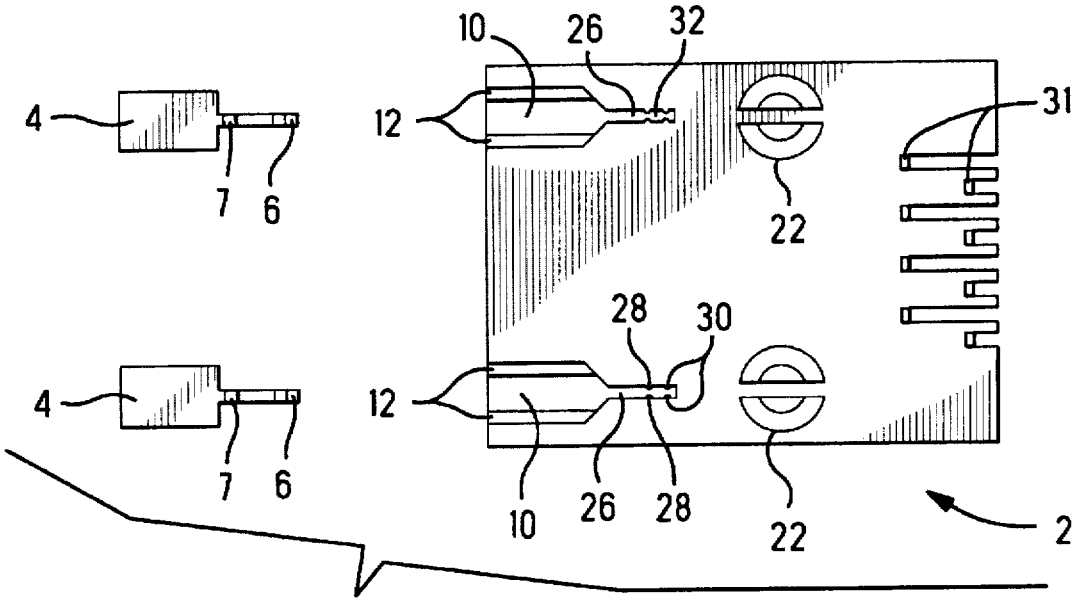
FIG. 3 shows a bottom view of the modular jack connector according to this invention.

Each of the major components will now be described in greater detail with reference to FIGS. 2 and 3. The insulative housing 8 is designed to receive a modular plug (not shown) into the main cavity 20 and utilizes well known latching features for maintaining the modular plug therein. Guide posts 22 are provided on the mating face 18 for properly aligning the modular jack receptacle 2 to a printed circuit board. Electrical contacts 30 are formed to mate with a modular jack plug (not shown) in the main cavity 20 and extend through the receptacle 2 to solder tails 31 departing from a board-mounting face 18 for connection to the printed circuit board. The insulative housing 8 also has two auxiliary cavities 10 for receiving indicators 4. The auxiliary cavities 10 are profiled to have guide rails or projections 12 disposed along opposed inner walls thereof and extending into the cavity 10. The auxiliary cavity 10 also has a lead receiving section 26 at its rear end. The lead receiving section 26 is profiled to have a first pair of protuberances 28 disposed along its inner walls and a second pair of protuberances 30 also disposed along its inner walls rearward of the first pair of protuberances 28. These pairs of protuberances 28, 30 define a lead receiving detent 32 therebetween. It should be understood that while the preferred lead receiving section 26 is shown here with a single detent 32 for engaging the lead 6, a second detent could be added to engage the second lead 7 for secondarily securing the indicator 4.

The indicator 4 will now be described in greater detail. The indicator 4 consists of an LED which is either overmolded or potted of plastic material to form a generally rectangular shaped indicator 4. The plastic material is generally translucent and is profiled to fit securely in the auxiliary recess 10 of the housing 8. Guide grooves 14 are disposed along opposed sides of the indicator 4 for cooperation with guide projections 12 of the housing 8. Leads 6,7 extend from the plastic material in a rearward direction and are bent at a right angle to eventually extend below the board-mounting face 18 of the receptacle 2 for connection to a printed circuit board.

Figure 4:
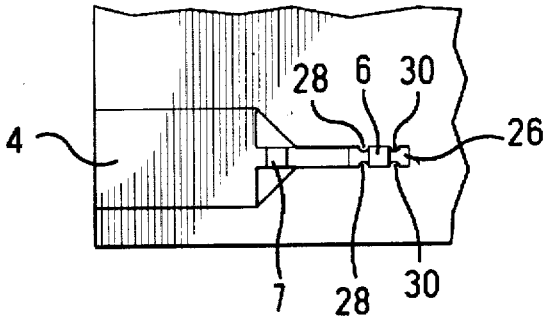
FIG. 4 shows a bottom view of the auxiliary recess and an indicator installed therein.

The modular jack receptacle 2 is assembled by first inserting the electrical contacts 30 into the housing 8 by any acceptable known method. The indicators 4 are then inserted into the auxiliary cavities 10 of the housing such that guide grooves 14 are aligned with guide projections 12 of the housing 8. The indicators 4 are then urged from the mating face 18 in a rearward direction until the rearmost lead 6 enters into the lead receiving area 26 of the auxiliary cavity 10. The indicator 4 is then urged further into its final position such that the rearmost lead 6 is locked into the lead receiving detent 32 as shown in FIG. 4.

Figure 5:
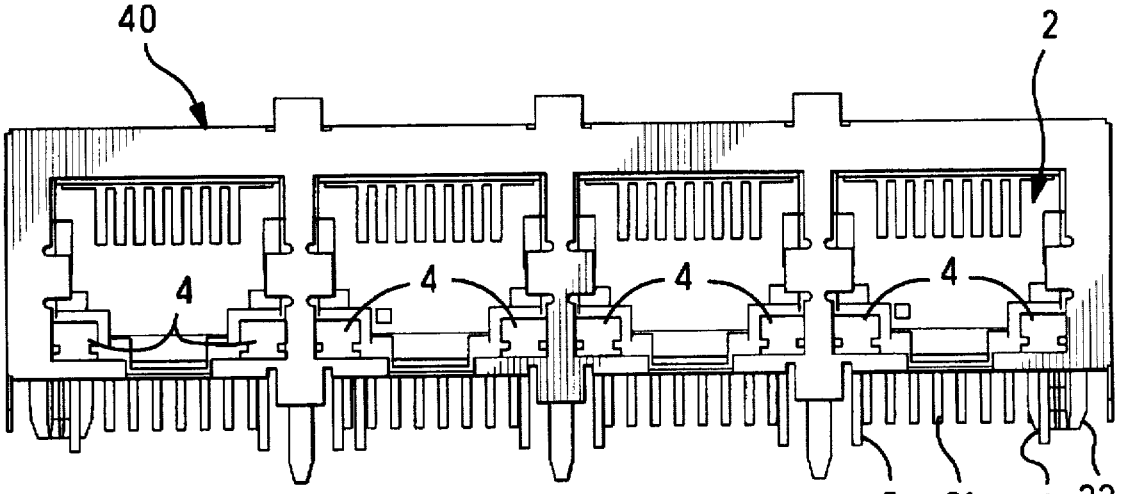
FIG. 5 shows a front view of an electrical connector utilizing several modular jack connectors according to this invention.

FIG. 5 shows a variation on the present invention wherein indicators 4 are utilized in a similar fashion as described above for a multiple connector assembly 40. It should be understood that while this multiple connector assembly 40 is shown here having four modular jack receptacles 2, the indicators 4 described herein may be utilized with any number of modular jack receptacles 2 be incorporated into a multiple connector assembly. It should also be understood that while each modular jack receptacle 2 is shown here having indicators 4, the same concepts may be applied in order to produce a modular receptacle 2 having only one indicator 4 or a plurality of indictors 4.

The advantage of this invention is that the indicators 4 are properly positioned for mounting to a printed circuit board and are firmly secured into auxiliary recesses 10 of the housing 8 without the use of any adhesive material. The elimination of the need for adhesive material removes a manufacturing step and therefore reduces overall manufacturing cost of the connector. Another advantage is that because the leads 6,7 are positioned such that one is adjacent the mating face 16, it is easily discernable as either the cathode or anode of the indicator 4. This will avoid confusion and assure proper polarity in connecting the indicator to a circuit.

We claim:

1. A modular jack connector receptacle for board mounting having at least one recess for receiving an indicator comprising:

a pair of guide projections disposed along opposed inner walls of the recess and projecting therefrom into the recess for cooperation with complementary guide grooves of an indicator; and a lead receiving section communicating with the recess and having at least one detent formed therealong for cooperation with a lead of the indicator, whereby the indicator is insertable into and securable in the recess by the cooperation of the lead with the detent and the guide projections with the complementary guide grooves of the indicator.

2. The connector receptacle of claim 1 wherein said detent is defined by and between pairs of forward and rearward opposing protuberances projecting into the lead receiving section.

3. An indicator for an electrical connector comprising:

an LED having leads extending therefrom; and an insulative body formed over the LED such that the leads extend from an inside of the body through a major surface thereof, the body being profiled to have at least one guide groove on another major surface thereof for cooperation with a corresponding projection in a recess of an electrical connector and for guiding the indicator into a proper position in the electrical connector.

4. The indicator of claim 3 wherein the insulative body is translucent.

5. The indicator of claim 3 wherein the indicator body includes guide grooves on opposed major surfaces thereof.

* * * * *